US005279023A

United States Patent [19]

Strudel et al.

[11] Patent Number: 5,279,023

[45] Date of Patent: Jan. 18, 1994

[54] METHOD FOR AVOIDING EDGE-MARKINGS IN TUBULAR KNITTED FABRICS AND APPARATUS FOR CARRYING OUT THE METHOD

[75] Inventors: Werner Strudel, Friedrichshafen, Fed. Rep. of Germany; Klaus Burkhardt, Reutte/Tirol, Austria

[73] Assignee: Lindauer Dornier GmbH, Lindau, Fed. Rep. of Germany

[21] Appl. No.: 915,005

[22] Filed: Jul. 16, 1992

[30] Foreign Application Priority Data

Jul. 16, 1991 [DE] Fed. Rep. of Germany ..... 4123477

[51] Int. Cl.[5] ..... D06C 3/06; D06B 15/02

[52] U.S. Cl. ..... 26/85; 68/22 R

[58] Field of Search ..... 68/22R; 26/80, 85

[56] References Cited

U.S. PATENT DOCUMENTS

| | | | |
|---|---|---|---|
| 1,141,883 | 6/1915 | Parkes | 26/85 |
| 3,501,818 | 3/1970 | Heitkamp | 26/85 |

FOREIGN PATENT DOCUMENTS

| | | | |
|---|---|---|---|
| 0166316 | 1/1986 | European Pat. Off. . | |
| 742075 | 11/1943 | Fed. Rep. of Germany | 26/85 |
| 3600559 | 7/1987 | Fed. Rep. of Germany . | |
| 3619922 | 12/1987 | Fed. Rep. of Germany . | |
| 2430997 | 3/1980 | France | 26/85 |
| 802750 | 10/1958 | United Kingdom | 26/85 |
| 940339 | 10/1963 | United Kingdom | 26/85 |

*Primary Examiner*—Philip R. Coe
*Attorney, Agent, or Firm*—W. G. Fasse

[57] ABSTRACT

A tubular knitted fabric is guided over a first rotatably arranged system of squeezing roller pairs and is then squeezed out, during a simultaneous continuous pulling off of the fabric, by a second system of squeezing rollers cooperating with the first system. The creation of edge markings is thereby completely prevented. An apparatus for the squeezing out process has a first system of rotatably arranged squeezing roller pairs which is held inside of the tubular fabric front the outside thereof and which has an adjustable outer periphery and a second system of rotatably arranged squeezing rollers also held on the outside of the tubular fabric. The second system is adapted to the periphery of the first system of squeezing roller pairs. Both systems cooperate with each other.

13 Claims, 6 Drawing Sheets

METHOD FOR AVOIDING EDGE-MARKINGS IN TUBULAR KNITTED FABRICS AND APPARATUS FOR CARRYING OUT THE METHOD

FIELD OF THE INVENTION

It has always been required that, during the consecutive processes of wet-refining tubular mesh or knit fabrics, the refining solution be uniformly squeezed out of the fabric, so that so-called edge-markings are not visible in the tubular-fabric after the squeezing.

BACKGROUND INFORMATION

It is necessary to carry out the squeezing of the tubular fabric in an exactly defined manner during dyeing of the fabric with active dyes, in order to achieve a flawless product quality, that is to say, dyeing quality.

After squeezing by the generally known squeezing devices, wherein the tubular textile material strip is guided through two motorized squeezing rollers, one of which is rotatably mounted in a fixed position on the machine frame and the other of which is mounted to be adjustable relative to the first, two-ply flat tubular-fabric always has edge-markings. More specifically, the edge of the two-ply, flat tubular-fabric is deformed when squeezing rollers with relatively hard surfaces are used, while the squeezing effect is diminished if the rollers have a relatively soft surface. A portion of the refining solution that has been squeezed out of the tubular fabric, thereby flows along both sides of the two-ply, flat tubular-fabric back into the edge area of the fabric after the fabric has left the squeezing roller groove. This leads to qualitatively varying results in the removal of the refining solution across the width of the fabric. This means, for example, that in the center of the fabric the refining solution is almost completely removed, while undesired refining solution is still found in the edges, that is, in the bent edge. Thus, fabrics with a poor wettability have light edge-markings, while fabrics with a good wettability have darker markings.

Various efforts have been made to overcome the above problem which adversely affects the fabric quality. According to German Patent Publication (DE-OS) 3,619,922, a method of dyeing tubular fabrics and an apparatus to carry out the known method are described, which aim at reliably avoiding a permanent edge-marking even with hard to process materials and even when the recipe of the reaction dye is not optimally set.

It is shown in the DE-OS 3,619,922 that the edge-markings which form in the fabric during padding are displaced after said padding, and that after this displacement of the edge-markings, but before the cold dwelling time, the fabric is squeezed again. The apparatus to carry out the known method is only sketchily described. The construction of the apparatus for displacing the edge markings and for squeezing the tubular fabric is not described in detail.

German Patent Publication (DE-OS) 3,600,559 discloses an apparatus for wet processing continuously moving tubular fabric, which has for its aim the forming of the tubular fabric in such a way that all edge markings resulting from the squeezing out process are avoided and so that an especially uniform fabric output is achieved. To achieve this aim, it is suggested that a tubular spreader with a circular cross-section that reaches into the edge markings on both sides and spreads the fabric out, is provided along the right and left edges downstream of the squeezing rollers as viewed in the motion direction of the fabric. Each ring of the tubular spreader should thereby cooperate with a pressure roller lying on the outside, in such a way that the edge marking of the tubular fabric between the respective ring and pressure roller becomes equalized. However, this solution in the DE-OS 3,600,559 does not offer the possibility of generally avoiding edge markings altogether during wet processing of tubular fabric.

European Patent EP 0,166,316 describes a method for the removal of edge-markings in tubular knitted fabric and an apparatus for carrying out the method, whereby the edge-markings resulting from the squeezing-out effect during the dyeing of the tubular knitted fabric should be avoided altogether. According to European Patent EP 0,166,316 this is achieved in that the stitched fabric is inflated like a balloon by means of steam and then laid flat again at least once during the fixing of the applied dye. An apparatus to carry out the known method has at least one nozzle for inflating the stitched fabric, attached between the dipping trough and the guide rollers which guide the tubular fabric.

OBJECTS OF THE INVENTION

In view of the foregoing it is the aim of the invention to achieve the following objects singly or in combination:

to provide an apparatus for avoiding edge markings in textile tubular fabrics;

to exclude the formation of edge markings in the tubular fabric in the first place;

to perform a defined all-around uniform squeezing-out of the dye stuff from the tubular fabric;

to avoid guiding the wet tubular knit fabric to the squeezing rollers in a flat, spread-out form; and to transform the wet tubular knit fabric from the flat, laid-out condition to a circular or otherwise spatially spread-out condition and to perform the squeeze-out when the fabric is in this spread-out condition so that the fabric is squeezed out all around while continually moving the fabric.

SUMMARY OF THE INVENTION

An apparatus for spreading tubular fabric according to the invention avoids edge markings in the tubular fabric which has been drenched in refining solution, by the cooperation of the following features. A frame structure with a central longitudinal axis supports first and second squeezing roller systems. The first system of rotatable first squeezing rollers is positioned inside the tubular fabric when the fabric passes through the apparatus. The first squeezing rollers are positioned relative to each other to define for the tubular fabric a spreader configuration which has a spreader periphery. A central telescoping carrier supported in the frame structure carries upper and lower supports for carrying the first squeezing rollers. The central telescoping carrier is so constructed that it permits adjusting the first squeezing rollers radially inwardly and radially outwardly relative to the central longitudinal axis for decreasing and increasing the spreader periphery respectively. The second system of rotatable second squeezing rollers is mounted in the frame structure so that the second squeezing rollers are positioned outside the tubular fabric when the fabric passes through the apparatus for supporting the first system of rotatable first squeezing rollers. A roller position adjusting mechanism is provided in the frame structure and connected to the second rotatable system of second squeezing rollers for adjusting the position of the rotatable second squeezing rollers radially relative to said first rotatable system of squeezing rollers to influence a squeezing gap between the rotatable first and second squeezing rollers. This roller position adjusting mechanism comprises a plurality of pivoted levers carrying the second squeezing rollers and an arrangement for adjusting said pivoted levers, thereby positioning said second squeezing rollers relative to said first squeezing rollers to form the squeezing gap between the first and second rollers. A drive device is operatively connected to the second system of rotatable second squeezing rollers for rotating the second system. Further, the first and second squeezing rollers are held in a common slanted position at an angle $\alpha$ relative to the central longitudinal axis of the apparatus for influencing the travel of the fabric through the apparatus.

Edge marking cannot even develope in the squeeze-out operation of the present apparatus. This is a substantial advantage of the present invention.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
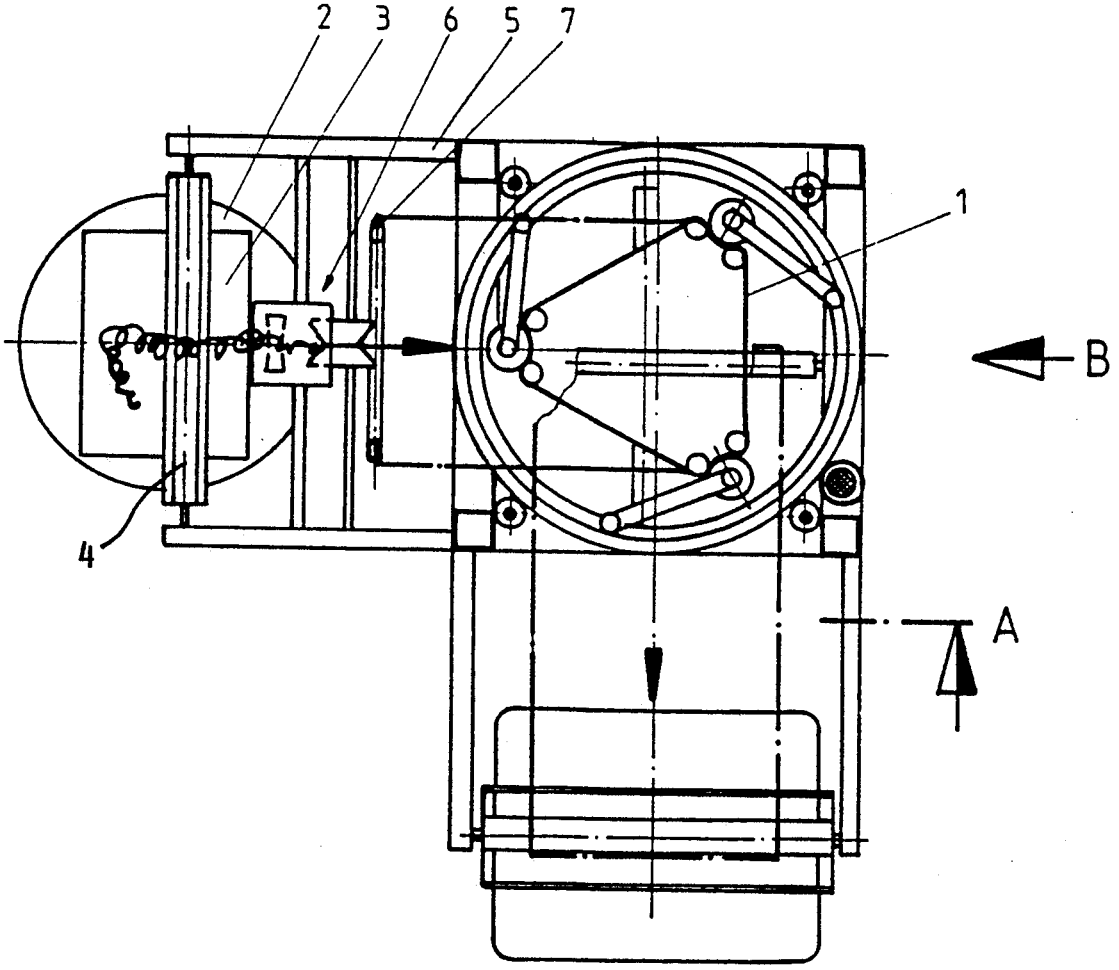
FIG. 1 shows a top view of the apparatus with inlet and outlet sections for the tubular fabric.
Figure 2:
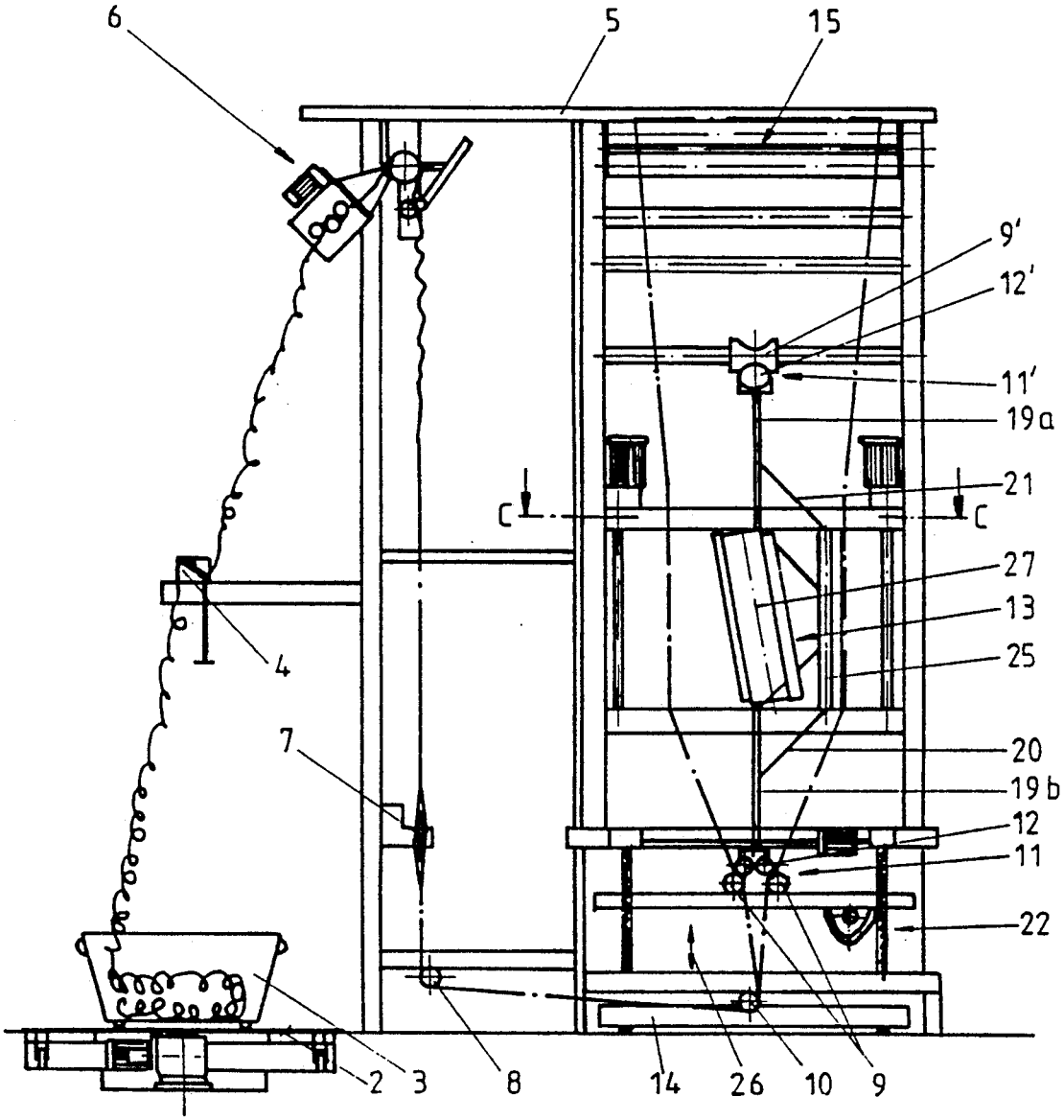
FIG. 2 shows a view in the direction "A" of the apparatus with the inlet section according to FIG. 1.

In FIGS. 1 and 2, the tubular knit fabric 1 is available in a rope-like form and is laid in a trough 3 carried on a turntable 2. The fabric may also be laid in the trough 3 in a folded form. The fabric 1 runs from the trough 3 out over a variable tension roller 4 into a disentangling head 6, which is attached as high as possible to the machine frame 5. A flat spreader 7 which is attached to the frame 5 is arranged downstream of the disentangling head 6. The tubular fabric 1 is spread out flat in the spreader 7 as viewed in the travel direction of the fabric 1. The tubular fabric 1 arrives over a first guide roller 8 and travels to a second guide roller 10 which is attached below a pair of fixing rollers 9, 9'. A lower spreader head 11, comprising backing rollers 12, 12' arranged in pairs and the corresponding pairs of fixing rollers 9, 9' is arranged downstream of the guide roller 10. The fabric 1 now runs through between the backing rollers 12, 12' and the corresponding fixing rollers 9, 9', whereby the fabric; and is spread out in a somewhat circular fashion, as described below, whereby the fabric is squeezed out by individual squeezing devices 13, which are arranged inside and around the outside of the tubular fabric 1. The squeezing takes place while the fabric is continuously moving so that the solution can run off downwardly into a solution container 14 along the travelling tubular fabric.

Figure 3:
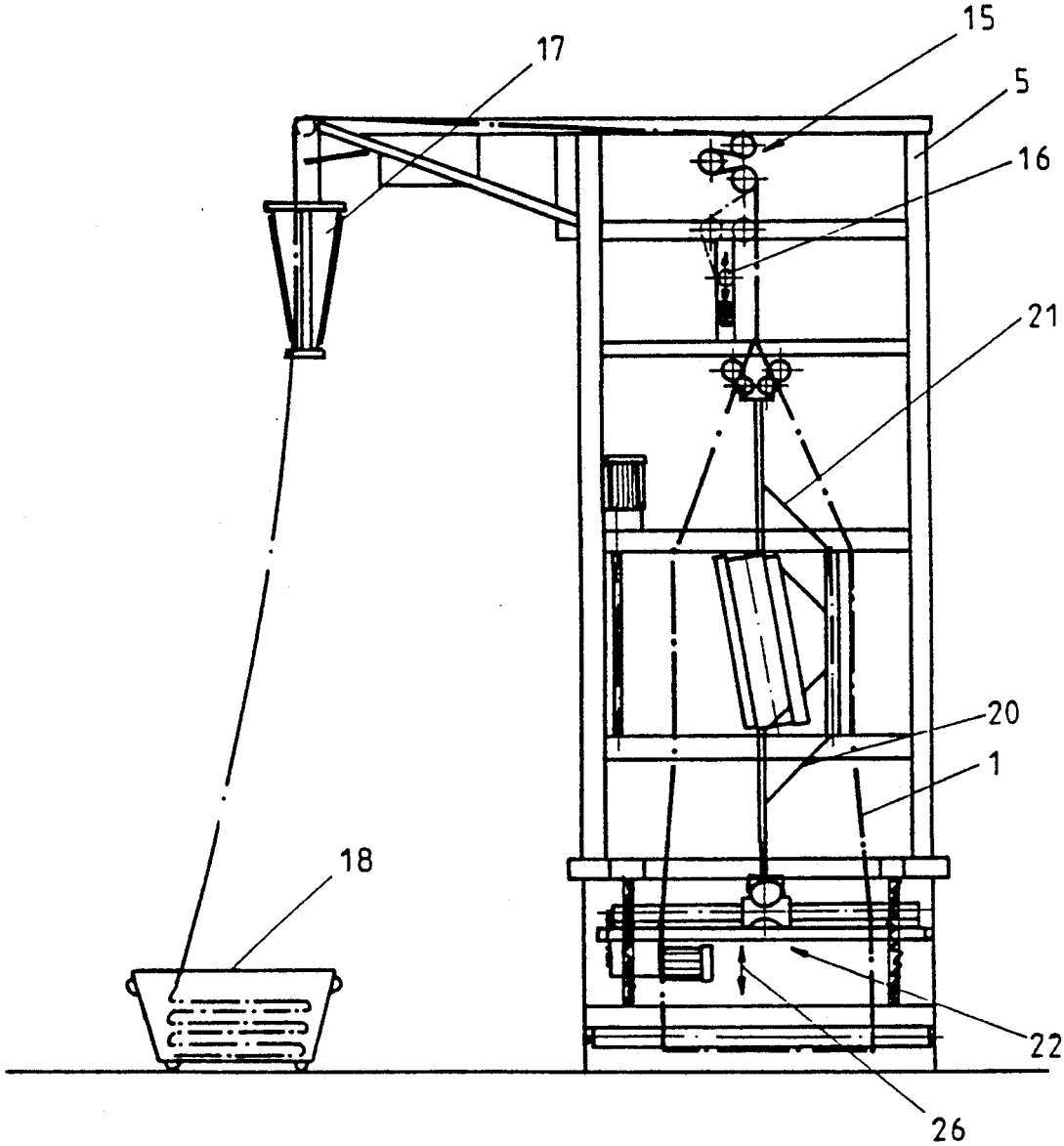
FIG. 3 shows a view in the direction "B" of the apparatus with the outlet section according to FIG. 1.

After the squeezing out process, the fabric 1 is pulled off over an upper spreader head 11 (FIGS. 2 and 3) which forms a flat, spread out fabric driven by a rubber roller arrangement 15 that is attached in the upper region of the frame 5. To achieve a constant fabric pull-off force, the fabric 1 can be guided over a compensating roller 16 with an adjustable tension force. The roller 16 is attached downstream of the spreader head 11' and upstream of the rubber roller arrangement 15. Downstream of the roller arrangement 15, the fabric 1 is guided over a folding device 17 in the upper frame region and then the fabric is delivered in a folded state into a container 18. Rather than folding the damp fabric, it is also possible to guide the fabric through a dryer, after the squeezing out process.

Figure 4:
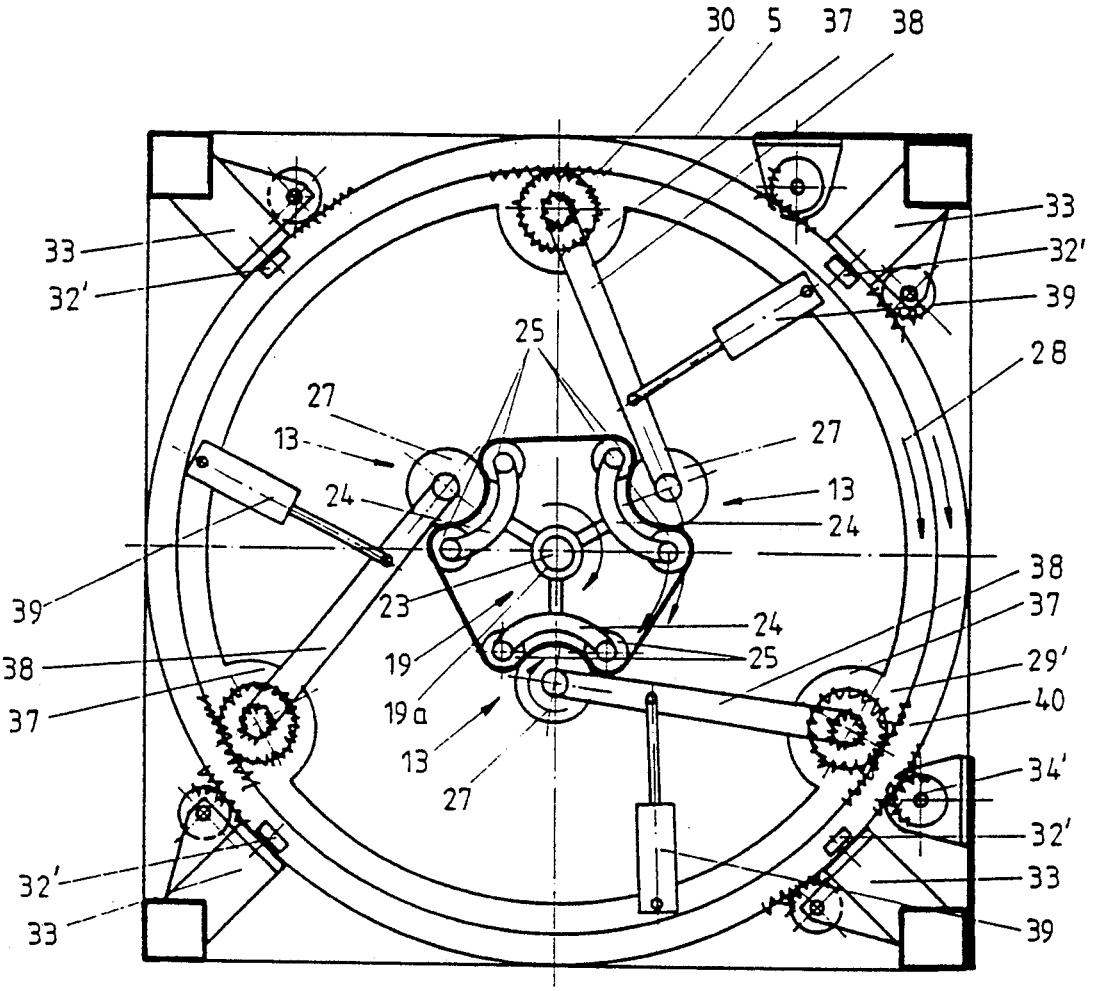
FIG. 4 is a cross-section along line C—C of FIG. 2 for a small tubular diameter fabric.
Figure 5:
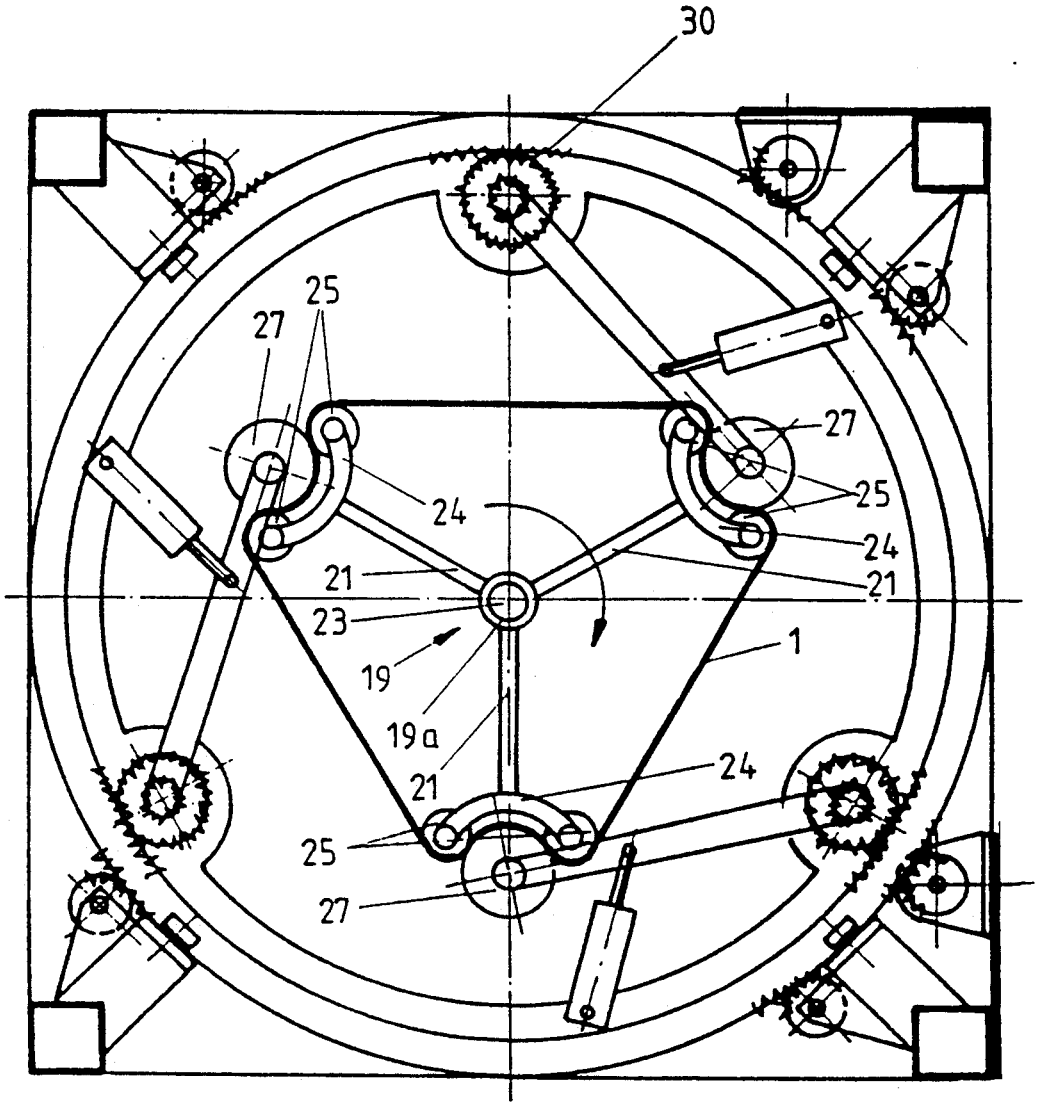
FIG. 5 is a cross-section along line C—C of FIG. 2 for a large tubular diameter fabric.

The present apparatus is housed in a frame 5, as shown in FIGS. 1 to 5. The frame 5 has a container 14 for wet processing the tubular fabric. The refining solution is collected in the container 14 at the bottom of the frame 5 as best seen in FIG. 2. The fabric is wet processed and laid down wet in a trough 3. In the lower region of the frame 5, there is provided a carrying and adjusting device 22 for the lower spreader head 11. This carrying device can raise or lower the lower spreader head 11 in the direction of the double arrow 26. The device that carries the lower spreader head 11 can hereby adjust the height of the telescopic central carrier 19 which has lower and upper supports 20, 21. The carrying device 22 could also be attached to the frame 5 in the upper frame region where the spreader head 11' is arranged. The detailed construction and interaction of the individual elements of the carrying device are not essential to the invention and are therefore not further described here. The squeezing-out device of the invention is arranged inside the frame 5. Its central carrier 19 comprises a middle guiding component 23, an upper carrier component 19*a* that is guided thereon, and a lower carrier component 19*b*. The guiding component and the carrier components may, for example, be constructed as tubes. The respective supports 20, 21 are arranged on a crosswise plane and distributed on the circumference of the upper and lower carrier components 19*a* and 19*b*. Each of these supports 20, 21 carries a curved carrier arm 24 at its free end as shown in FIGS. 4 and 5. This carrier arm 24 supports the axis end of squeezing rollers 25 forming a squeezing roller pair. A further carrier arm not shown but the same as carrier arm 24 of the lower support 20 takes up the other axis end of the respective squeezing roller 25. A corresponding lower carrier arm is arranged for each of the upper carrier arms 24.

Both carrier arms together carry two inner squeezing rollers 25, which together form an inner squeezing roller pair, in such a way that these rollers are rotatable. The lower and upper supports 20, 21 with the carrier arms 24 thereby form a connection to the inner squeezing rollers 25, over which the tubular fabric 1 is guided. Due to the telescopically constructed carrier 19, which carries the supports 20, 21 that are pivoted, that is to say in a rotatable and swivelable manner, and due to its lower and upper carrier components 19*b*, 19*a*, and further due to the above mentioned adjustment of the stroke along the double arrow 26, the inner squeezing roller pairs can be adjusted to the necessary diameter of the tubular fabric 1. An outer rotationally driven squeezing roller 27 for squeezing out of the tubular fabric 1 is arranged for cooperation with each inner squeezing roller pair in such a way that the outer roller is adjustable in a horizontal plane toward the inner roller pair.

Figure 6:
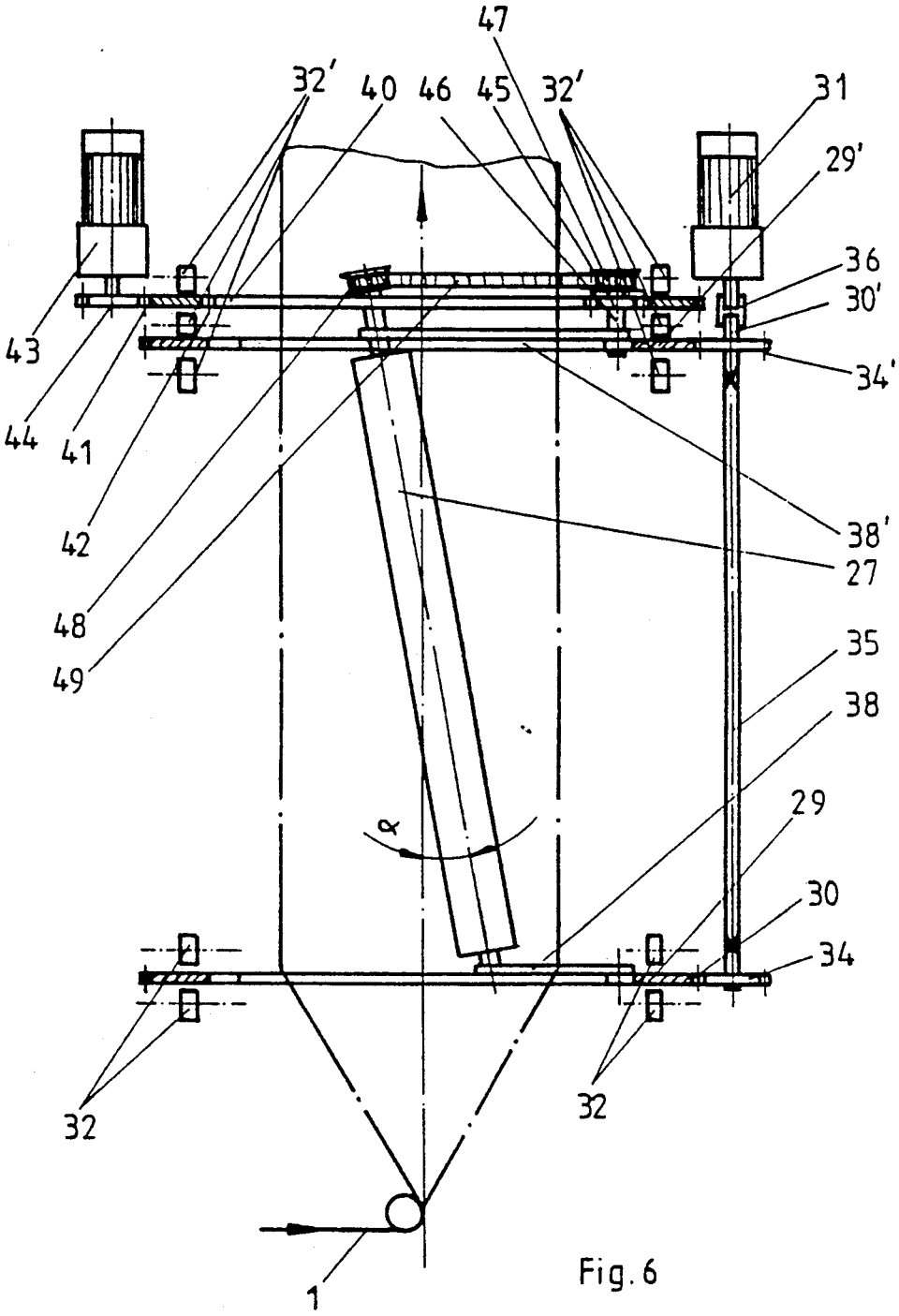
FIG. 6 schematically shows the drive mechanism of the squeezing-out system.

The arrangement described as an outer squeezing roller system is characterized in that, the functioning region of the carrier device 19 comprises two ring bearings 29, 29', which are arranged around the carier device 19 so as to be rotatable in the direction of the arrow 28 (FIG. 4). These ring bearings 29, 29' have a sketchily depicted outer toothing 30, 30'. Both ring bearings 29, 29' have a common drive 31. One ring bearing 29, 29' is attached below the operational region, while the other ring bearing is attached above the operational region of the carrier arrangement 19. The ring bearings are rotatably mounted between roller guides 32 that have carrier arms 33 reaching inside of the frame. Each of the ring bearings 29, 29' meshes through its outer toothing 30, 30' with a pinion 34, 34'. The pinions 34, 34' are drivingly connected with a motor drive 31 through a vertically extending shaft 35, which in turn is connected to the motor 31 by a clutch 36. The lower and upper ring bearing 29, 29' has bearing eyes 37 arranged spaced apart from one another on its inner diameter on a reference circle. A pivoted lever 38 that carries the outer squeezing roller 27 is rotatably mounted in each of the bearing eyes 37. Each pivoted lever 38 is connected to an arrangement 39 that adjusts the pivot direction of the pivoted lever 38 and the bearing pressure on the squeezing roller pairs. This arrangement 39 is preferably a pneumatically driven piston cylinder unit and the arrangements 39 are supported on the corresponding ring bearing 29, 29' and are simultaneously rotatably supported thereon. In order to be able to continuously pull off the tubular knitted fabric during the squeezing out process, each inner squeezing roller pair 25 and the outer squeezing roller 27, which together form the squeezing device 13, are adjusted at an angle $\alpha$ to the vertical, as is shown in FIG. 6 for one of the outer squeezing rollers 27. Another revolving ring bearing 40 which is also vertically guided between the rollers 32' that are attached to the frame 5, is mounted above the ring bearing 29' and has inner and outer gear teeth 41, 42. The outer gear teeth 41 meshes with a pinion 44 that is driven by a motor 43. Further pinions 45 mesh with the inner gear teeth 42, whereby each of these pinions is carried by a shaft 46 which is mounted by a corresponding bearing eye of the upper ring bearing 29'. The shaft 46 carries a belt pulley 47 on its free end above the pinion 45.

The free end of the upper squeezing roller stub of the squeezing roller 27 that is supported by the pivoted lever 38' of the ring bearing 29', also carries a belt pulley 48. Both belt pulleys 47, 48 are coupled to each other by a V-belt 49. As described above, all squeezing rollers 25, 27 which cooperate in pulling along the fabric, are arranged in the same manner or same direction at an angle $\alpha$ to the vertical. For example, a fabric pulling off speed of 20 m/min is achieved when there is a squeezing roller angle $\alpha$ of 10° and a tubular fabric width of 1 m (measured flat), and further when the outer and inner squeezing systems set the ring bearings 29, 29' in rotation at 60 r.p.m., whereby each fabric section runs through the squeezing gap of each squeezing device 13 ten times.

In order to prevent the tubular fabric 1 from being caused to rotate by the squeezing devices, each of the outer squeezing rollers 27 is driven by the above mentioned driving system that is separate from the motor 43, and in such a way that the outer squeezing rollers 27 roll off of the tubular fabric 1. The outer squeezing rollers 27 are, therefore, driven in the opposite direction of the rotational movement of the inner system, due to the rotation imposed on the inner squeezing roller system by the outer system. The rotation directions are shown in FIG. 4 by the corresponding arrows.

The motor 43 is electrically coupled with the drive 31, suitably by a frequency stabilization that is not depicted in detail here. Thus, tolerances, that arise from the rotation of the inner and outer squeezing out systems in relation to the rotation of the separately driven outer squeezing rollers 27, are thereby equalized. The tubular fabric 1 can thereby be held free of rotation during the squeezing out process and the continuous pulling off. This adjusting can be achieved manually or automatically.

Although the invention has been described with reference to specific example embodiments, it will be appreciated that it is intended to cover all modifications and equivalents within the scope of the appended claims.

We claim:

1. An apparatus for spreading tubular fabric, thereby avoiding edge markings in said tubular fabric which has been drenched in refining solution, comprising a frame structure having a central longitudinal axis, a first system of rotatable first squeezing rollers (25) to be positioned inside said tubular fabric, said first squeezing rollers (25) being positioned relative to each other to define a spreader configuration for said tubular fabric, said spreader configuration having a spreader periphery, a central telescoping carrier (19) supported in said frame structure, said central telescoping carrier comprising upper and lower supports (20, 21) carrying said first squeezing rollers (25), said central telescoping carrier permitting adjusting said first squeezing rollers (25) radially inwardly and radially outwardly relative to said central longitudinal axis for decreasing and increasing said spreader periphery respectively, a second system of rotatable second squeezing rollers (27) mounted in said frame structure to be positioned outside said tubular fabric for pressing said rotatable second squeezing rollers (27) against said rotatable first squeezing rollers (25), means (39) in said frame structure connected to said rotatable system of second squeezing rollers (27) for adjusting a position of said rotatable second squeezing rollers (27) radially relative to said first rotatable system of squeezing rollers (25) to influence a squeezing gap between said rotatable first and second squeezing rollers (25, 27), said means for adjusting said position of said second squeezing rollers comprising a plurality of pivoted levers (38, 38') carrying said second squeezing rollers (27) and an arrangement (39) for operating said pivoted levers, thereby positioning said second squeezing rollers (27) relative to said first squeezing rollers (25), and a drive device (40, 43, 44, 45, 46, 47, 48, 49) operatively connected to said second system of rotatable second squeezing rollers (27) for rotating said second system, and wherein said first and second squeezing rollers (25 and 27) are held in a common slanted position at an angle $\alpha$ relative to said central longitudinal axis.

2. The apparatus of claim 1, wherein said first system of first squeezing rollers comprising pairs of first squeezing rollers, said central carrier (19) comprising a guiding component (23) for said upper and lower supports (20, 21) arranged rotatably around said guiding component (23), a curved carrier arm (24) arranged at a free end of each of said upper and lower supports (20,

21), said pairs of said first squeezing rollers (25) being rotatably mounted to each free end of said carrier arms (24).

3. The apparatus of claim 1, wherein said central telescoping carrier (19) of said first system of first squeezing rollers comprises at each of its outer ends a backing roller pair (12, 12'), said apparatus further comprising a fixing roller pair (9, 9') arranged in said frame structure outside of said tubular fabric (1), said backing roller pair bearing against said fixing roller pair for positioning said central telescoping carrier (19) between said backing roller and fixing roller pairs.

4. The apparatus of claim 3, wherein at least one of said fixing roller pairs (9) is adjustable lengthwise to said central telescoping carrier (19).

5. The apparatus of claim 1, wherein said central telescoping carrier (19) comprises components (19*a*, 19*b*) displaceable axially relative to each other and interlockable with each other in any axially displaced position.

6. The apparatus of claim 1, wherein said second system of second squeezing rollers (27) comprises an upper and a lower ring bearing (29, 29') with outer gear teeth (30) for positioning said second squeezing rollers (27), said ring bearings limiting vertically a squeezing out region, each of said pivoted levers (38) mounting one of said second squeezing rollers, and drive means (31, 34, 34', 35, 36) for interconnecting and driving said two ring bearings (29, 29'), and wherein each ring bearing (29, 29') carries said pivoted layers (38) for positioning said second squeezing rollers (27) relative to the corresponding first squeezing rollers (25).

7. The apparatus of claim 6, wherein said drive means comprise pinions (34, 34'), a motor (31), a clutch (36), and a vertically extending shaft (35), said ring bearings (29, 29') being connected through said pinions (34, 34'), through said vertically extending shaft (35), and through said clutch (36) to said motor (31).

8. The apparatus of claim 6, wherein said pivoted levers comprise upper and lower pivoted levers (38, 38') for carrying said second squeezing rollers (27), said pivoted levers being arranged diametrically opposite each other, and wherein said upper pivoted levers are displaced by a rotation angle $\alpha$ relative to said lower pivoted levers, and means connecting said pivoted upper levers (38') to said upper ring bearing (29') and said pivoted lower levers (38) to said lower ring bearing (29).

9. The apparatus of claim 6, wherein said arrangement (39) for operating said pivoted levers (38, 38') is supported on said lower and upper ring bearings (29, 29'), and means connecting said pivoted levers (38, 38') to said operating arrangement.

10. The apparatus of claim 6, comprising a further ring bearing (40) with outer and inner gear teeth (41, 42) for rotating said second squeezing rollers, means (43, 44) for rotating said further ring bearing (40), supporting rollers (32) for supporting said further ring bearing (40) above said upper ring bearing (29'), said means for rotating comprising a first pinion (44) meshing with said further ring bearing (40), and a drive motor (43) for driving said pinion (44).

11. The apparatus of claim 10, wherein said means for rotating further comprise a shaft (46) connected to said upper ring bearing (29'), said shaft (46) simultaneously supporting said pivoted lever (38'), and a second pinion (45) meshing with said inner gear teeth (42) of said further ring bearing (40).

12. The apparatus of claim 11, wherein said means for rotating further comprise a first belt pulley (47) carried by said shaft (46) on an upper free end of said shaft (46), a second belt pulley (48) carried by a respective second squeezing roller (27), and a V-belt (49) running around said first and second pulleys (47, 48) for rotating said second squeezing roller (27).

13. The apparatus of claim 12, wherein said second belt pulley (48) is connected to said second squeezing roller (27) where said second squeezing roller is connected to said pivoted lever (38').

* * * * *